US007449651B2

(12) United States Patent
Lin

(10) Patent No.: US 7,449,651 B2
(45) Date of Patent: Nov. 11, 2008

(54) PRESS KEY STRUCTURE

(75) Inventor: Ching-Ting Lin, Yilan County (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 0 days.

(21) Appl. No.: 12/007,935

(22) Filed: Jan. 17, 2008

(65) Prior Publication Data

US 2008/0185279 A1 Aug. 7, 2008

(30) Foreign Application Priority Data

Feb. 6, 2007 (TW) ..... 96202229 U

(51) Int. Cl.
*H01H 13/70* (2006.01)

(52) U.S. Cl. ..... 200/344; 200/345

(58) Field of Classification Search ..... 200/5 A, 200/517, 341, 344, 345
See application file for complete search history.

(56) References Cited

U.S. PATENT DOCUMENTS 5,268,545 A * 12/1993 Bruner ..... 200/345
5,769,210 A * 6/1998 Tsai ..... 200/344
5,813,521 A * 9/1998 Koike et al. ..... 200/344
6,060,676 A * 5/2000 Pan ..... 200/344
6,118,092 A * 9/2000 Hayashi ..... 200/344
6,706,985 B2 * 3/2004 Chun ..... 200/344
6,723,935 B1 * 4/2004 Watanabe ..... 200/344
6,812,421 B2 * 11/2004 Sato et al. ..... 200/344
6,936,782 B2 * 8/2005 Ito ..... 200/344
7,312,414 B2 * 12/2007 Yatsu et al. ..... 200/344
7,319,202 B2 * 1/2008 Sato et al. ..... 200/344

* cited by examiner

*Primary Examiner*—Michael A Friedhofer
(74) *Attorney, Agent, or Firm*—Birch, Stewart, Kolasch & Birch, LLP

(57) ABSTRACT

A press key structure is disclosed, which comprises: a keycap, configured with a bottom surface; a substrate; a first movable panel; and a second movable panel; wherein the substrate is arranged at a position underneath the keycap while disposing the first and the second movable panels in a space sandwiched between the substrate and the keycap and pivotally coupling the two by the use of a flange and a groove formed respectively on the two neighboring edges of the first and the second movable panels in a manner that the flange is slidably inset into the groove; and the each of the first and the second movable panels is coupled to the substrate by the center thereof while enabling the two edges of the first and the second movable panels that are away from each other to pivotally coupled to the bottom surface of the keycap. With the aforesaid structure, a first angle is included between the first and the second movable panels when the keycap is not pressed by a force; and a second angle that is larger than the first angle is included between the first and the second movable panels when the keycap is pressed.

15 Claims, 3 Drawing Sheets

PRESS KEY STRUCTURE

FIELD OF THE INVENTION

The present invention relates to an improved press key structure, and more particularly, to a press key structure capable of providing a uniform support to its keycap for preventing the same from slanting by pressing that is especially suitable for a press key with bar-shaped keypad.

BACKGROUND OF THE INVENTION

Conventionally, a press key 10 is usually constructed with a scissors-type elastic structure as shown in FIG. 1, which comprises: a keycap 13, a substrate 14 and two supporting arms 11, 12 sandwiched between the keycap 13 and the substrate 14. In FIG. 1, the two supporting arms 11, 12 are pivotally coupled with each other at the middle thereof forming an X-shaped structure. Such conventional scissors-type press key 10 is favored for its longer stroke and lower noise, etc., so that it is vastly adopted by those thin-type keyboards in recent year, especially for keyboards of notebook computers. However, such scissors-type press key 10 still has shortcomings. Namely, as the two supporting arms 11, 12 are pivotally coupled with each other at the middle thereof, the X-shaped structure of the two arms 11, 12 can only provide support to a small portion of the keycap 13. Thus, when it is used for supporting a bar-shaped keycap 13, as that shown in FIG. 1, and such keycap 13 is not pressed by a finger 20 exactly at a portion where it is supported by the X-shaped structure of the two arms 11, 12, the pressing of the finger 20 will cause the keycap 13 to tilt and thus the compress block 131 arranged at the bottom of the keycap 13 will not be able to press exactly on the elastic member 15 mounted on the substrate 14. Consequently, the conducting plate arranged at the bottom of the elastic member 15 will not be able to have an exact contact with the circuit board 16 disposed beneath the substrate 14, that is, the contact between the conducting panel and the circuit board is poor.

For preventing the aforesaid slanting from happening, it is commonly seen in the industry to integrally form an enforcement rib at the bottom of the keycap. Following the trend of lighter, thinner and smaller design, it is preferred to have thinner keycap. However, when a key cap is integrally formed with a poorly designed reinforcement structure or with a thick reinforcement structure, such keycap consequently is going to surfer for having a shrinking pressing surface that no only it is not good looking, but also the yield is poor. Moreover, as such reinforcement structure is disposed beneath the keycap, its disposition is restricted by those other structures formed under the keycap in a manner that it is unable to evenly distribute the pressing force over the entire surface of the keycap; and as the structure of such enforcement rib is comparatively complex, the manufacturing cost is increased.

SUMMARY OF THE INVENTION

In view of the disadvantages of prior art, the primary object of the present invention is to provide a press key structure capable of providing a uniform support to its keycap for preventing the same from slanting by pressing that is especially suitable for a press key with bar-shaped keypad.

To achieve the above object, the present invention provides a press key structure, comprising: a keycap, configured with a bottom surface; a substrate, disposed beneath the keycap; a first movable panel; and a second movable panel; wherein the first and the second movable panels are disposed in a space sandwiched between the substrate and the keycap while enabling the first and the second panels to pivotally couple with each other by the use of at least a flange and at least a groove formed respectively on the neighboring edges of the first and the second movable panels in a manner that the at least one flange is slidably inset into the corresponding at least one groove; and the each of the first and the second movable panels is coupled to the substrate by a position nearing the center thereof while enabling the two edges of the first and the second movable panels that are away from each other to pivotally coupled to the bottom surface of the keycap, and thereby, a first angle is included between the first and the second movable panels when the keycap is not subjected to a pressing force, and a second angle that is larger than the first angle is included between the first and the second movable panels when the keycap is pressed.

Preferably, the at least one flange is arranged at an edge of the first movable panel while the at least one groove is formed on the second movable panel at a position corresponding to the flange.

Preferably, the second movable panel is configured with a recess at an edge thereof neighboring to the first movable panel for receiving at least a portion of the first movable panel to extend therein.

Preferably, the at least one groove is formed in the recess as an elongated hole for allowing its corresponding flange to inset therein from the inside of the recess as soon as the first movable panel is extending into the recess.

Preferably, the first movable panel is configured with two flanges located at the two opposite edges in respective at positions close to the second movable panel while the second movable panel is configured with two grooves located at its two opposite edges in respective at positions corresponding to the two flanges.

Preferably, the insetting of at least one flange is into the corresponding at least one groove forms a pivot axis coupling the first movable panel with the second movable panel while allowing the at least one flange to slide in its corresponding groove in a direction perpendicular to the extending of the pivot axis.

Preferably, there are pivot axes to be formed respectively at the two edges of the first and the second movable panels that are away from each other.

Preferably, there are pivot seats to be formed at the bottom surface of the keycap at positions respectively corresponding to the pivot axes for allowing the pivot axes to inset therein and thus pivotally coupling the first and the second movable panels to the keycap.

Preferably, the pivot axes arranged respectively at the two edges of the first and the second movable panels that are away from each other are extending parallel to the extending of the pivot axis formed by the insetting of at least one flange is into the corresponding at least one groove.

Preferably, each of the pivot axes arranged respectively at the two edges of the first and the second movable panels that are away from each other is composed of two shafts, symmetrically attached to two opposite edges of its corresponding panel in an outward extending manner at positions near the edge of the corresponding panel that is far away from the other panel.

Preferably, there are support axes being configured respectively at the first and the second movable panels at positions nearing the center thereof.

Preferably, the substrate is configured with support seats at positions corresponding to the support axes for allowing the support axes to inset therein and thus pivotally coupling the first and the second movable panels to the substrate.

Preferably, the support axes arranged at positions nearing the center of the first and the second movable panels are extending parallel to the extending of the pivot axis formed by the insetting of at least one flange is into the corresponding at least one groove.

Preferably, each support axes being configured respectively at the first and the second movable panels at positions nearing the center thereof are composed of two shafts, symmetrically attached to two opposite edges of its corresponding panel in an outward extending manner.

Preferably, the support seats of the substrate are so constructed for elevating the first and the second movable panels to a specific height.

Preferably, the press key structure further comprises: an elastic member, disposed on the substrate at position corresponding to the bottom surface of the keycap in a manner that the elastic member is deformed when the keycap is subjecting to the pressing force enabling the bottom surface to press upon the elastic member, and recovers from the aforesaid deformation when the keycap is released.

Preferably, there are a conducting plate arranged at the bottom of the elastic member and a circuit board arranged beneath the substrate while enabling the conducting plate to electrically conduct with the circuit board as soon as the elastic member is pressed by the keycap.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 2:
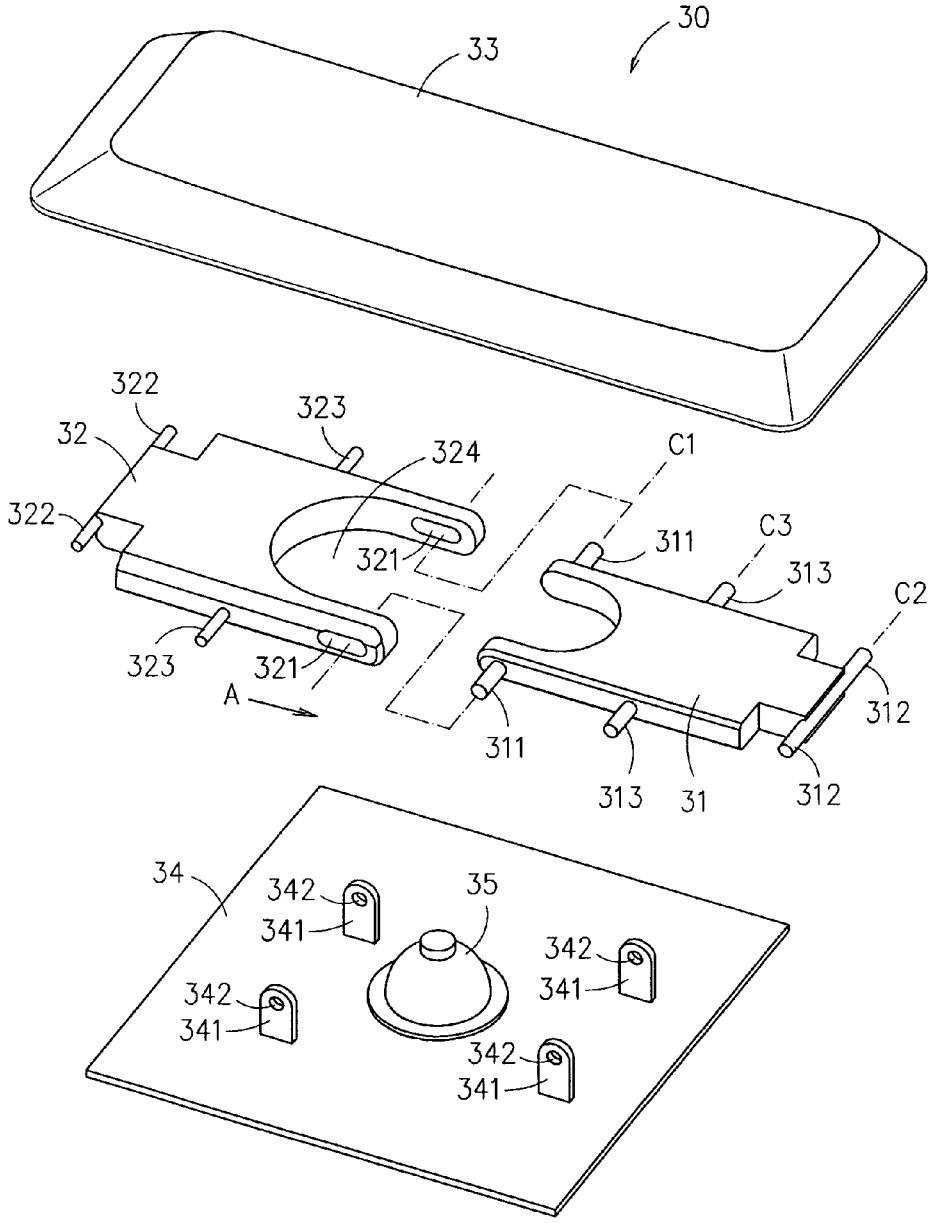
FIG. 2 is an exploded view of a press key structure according to an exemplary embodiment of the invention.
Figure 3:
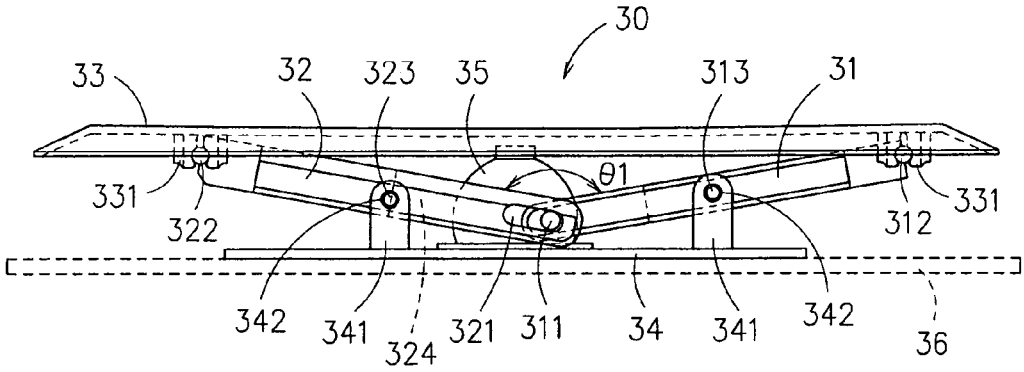
FIG. 3 is a side view of a press key structure according to an exemplary embodiment of the invention.

Please refer to FIG. 2 and FIG. 3, which show a press key structure according to an exemplary embodiment of the invention. The press key structure 30 in the embodiment comprises: a keycap 33, a substrate 34, and first movable panel 31 and a second movable panel 32. The keycap 33 is configured with a bottom surface while arranged the substrate 34 beneath the keycap 33 forming a space sandwiched therebetween for receiving the first and the second movable panels 31, 32 therein. The press key structure 30 further comprises an elastic member 35, which is disposed on the substrate 34 at position corresponding to the bottom surface of the keycap 33 in a manner that the elastic member 35 is deformed when the keycap 33 is subjecting to the pressing force enabling the bottom surface to press upon the elastic member 35, and recovers from the aforesaid deformation when the keycap 33 is released. Moreover, there are a conducting plate arranged at the bottom of the elastic member 35 and a circuit board 36 arranged beneath the substrate 34 while enabling the conducting plate to electrically conduct with the circuit board 36 as soon as the elastic member 35 is pressed by the keycap 33.

The press key structure of the invention is characterized in that: the first and the second panels 31, 32 to pivotally couple with each other by the use of at least a flange 311 and at least a groove 321 formed respectively on the neighboring edges of the first and the second movable panels 31, 32; and the second movable panel 32 is configured with a recess 324 at an edge thereof neighboring to the first movable panel 31 for receiving the portion of the first movable panel 31 configured with the at least one flange 311 to extend therein while enabling the at least one flange 311 to slidably inset their corresponding grooves 321 of the second movable panel 32 from the inside of the recess 324; and the insetting of at least one flange 311 is into the corresponding at least one groove 321 forms a pivot axis C1 coupling the first movable panel 31 with the second movable panel 32 while allowing the at least one flange 311 to slide in its corresponding groove 321 in a direction perpendicular to the extending of the pivot axis C1.

Figure 1:
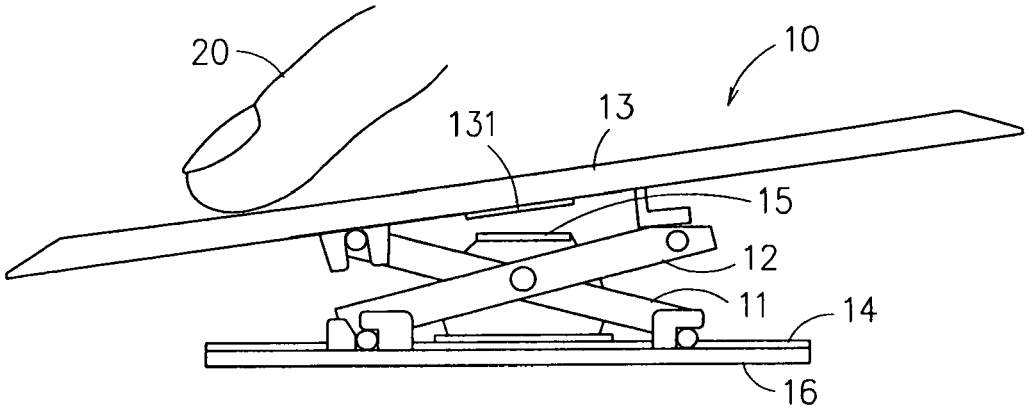
FIG. 1 (PRIOR ART)
FIG. 1 shows a conventional scissors-type press key as it is subjecting to a pressing force.

Furthermore, there are pivot axes 312, 322 to be formed respectively at the two edges of the first and the second movable panels 31, 32 that are away from each other; and there are pivot seats 331 to be formed at the bottom surface of the keycap 33 at positions respectively corresponding to the pivot axes 312, 322 for allowing the pivot axes 312, 322 to inset therein and thus pivotally coupling the first and the second movable panels 31, 32 to the keycap 33. In the embodiment shown in FIG. 1, each of the pivot axes 312, 322 is composed of two shafts, symmetrically attached to two opposite edges of its corresponding panel in an outward extending manner at positions near the edge of the corresponding panel that is far away from the other panel; and the pivot axes 312, 322 are extending parallel in a direction C2 parallel to the extending direction of the pivot axis C1 formed by the insetting of at least one flange 311 is into the corresponding at least one groove 321.

In addition, there are support axes 313, 323 being configured respectively at the first and the second movable panels 31, 32 at positions nearing the center thereof; and the substrate 34 is configured with support seats 341 at positions corresponding to the support axes 313, 323, in which there are holes formed in the support seats 341 to be used for allowing the support axes 313, 323 to inset therein and thus pivotally coupling the first and the second movable panels 31, 32 to the substrate 34. It is noted that the support axes 313, 323 are extending in a direction C3 parallel to the extending of the pivot axis C1 formed by the insetting of at least one flange is into the corresponding at least one groove, and the support seats 341 of the substrate 34 are so constructed for elevating the first and the second movable panels 31, 32 to a specific height.

Figure 4:
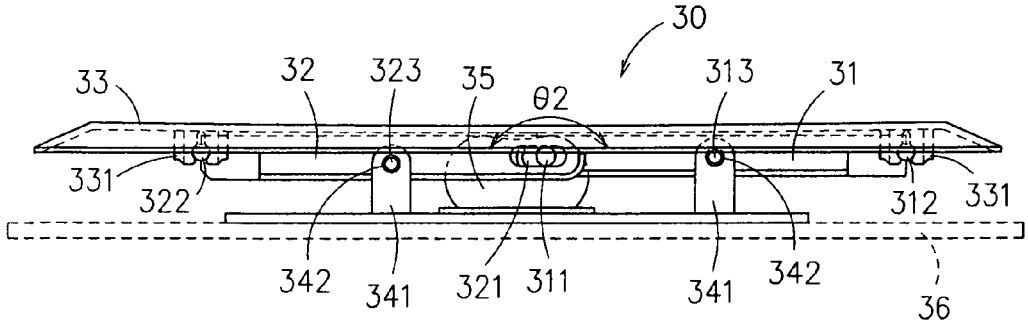
FIG. 4 shows the press key structure of FIG. 3 as it is subjecting to a pressing force.

With the aforesaid structure, a first angle $\theta_1$ is included between the first and the second movable panels 31, 32 when the keycap 33 is not pressed by a force as shown in FIG. 3; and a second angle $\theta_2$ that is larger than the first angle $\theta_1$ is included between the first and the second movable panels 31, 32 when the keycap 33 is pressed, as shown in FIG. 4. It is noted that as there is a comparative larger area of the keycap's bottom is supported by the construction of the first and the second movable panels 31, 32, the keycap 33 can be pressed to descend smoothly without tilting so that it can ensure the bottom of the keycap 33 to press on top of the elastic member 35 exactly and evenly for enabling the conducting plate arranged at the bottom of the elastic member 35 to have an exact contact with the circuit board without having to press the keycap 33 repetitively by poor electrical conduction. In addition, also as the first and the second movable panels 31, 32 can provide support to a comparative larger area of the keycap's bottom, there is no need to install addition enforcement rib to the bottom of the keycap 33 so that not only the whole press key structure is simplified and thus its manufacturing cost in reduced, but also the previous-mentioned problem of shrinking pressing surface can be prevented.

To sum up, the present invention provides a press key structure capable of providing a uniform support to its keycap for preventing the same from slanting by pressing that is especially suitable for a press key with bar-shaped keypad.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A press key structure, comprising:

a keycap, configured with a bottom surface;

a substrate, disposed beneath the keycap;

a first movable panel; and a second movable panel;

wherein the first and the second movable panels are disposed in a space sandwiched between the substrate and the keycap while enabling the first and the second panels to pivotally couple with each other by the use of at least a flange and at least a groove formed respectively on the neighboring edges of the first and the second movable panels in a manner that the at least one flange is slidably inset into the corresponding at least one groove; and the each of the first and the second movable panels is coupled to the substrate by a position nearing the center thereof while enabling the two edges of the first and the second movable panels that are away from each other to pivotally coupled to the bottom surface of the keycap, and thereby, a first angle is included between the first and the second movable panels when the keycap is not subjected to a pressing force, and a second angle that is larger than the first angle is included between the first and the second movable panels when the keycap is pressed.

2. The press key structure of claim 1, wherein the at least one flange is arranged at an edge of the first movable panel while the at least one groove is formed on the second movable panel at a position corresponding to the flange.

3. The press key structure of claim 2, wherein the second movable panel is configured with a recess at an edge thereof neighboring to the first movable panel for receiving at least a portion of the first movable panel to extend therein.

4. The press key structure of claim 3, wherein the at least one groove is formed in the recess as an elongated hole for allowing its corresponding flange to inset therein from the inside of the recess as soon as the first movable panel is extending into the recess.

5. The press key structure of claim 2, wherein the first movable panel is configured with two flanges located at the two opposite edges in respective at positions close to the second movable panel while the second movable panel is configured with two grooves located at its two opposite edges in respective at positions corresponding to the two flanges.

6. The press key structure of claim 1, wherein the insetting of at least one flange is into the corresponding at least one groove forms a pivot axis coupling the first movable panel with the second movable panel while allowing the at least one flange to slide in its corresponding groove in a direction perpendicular to the extending of the pivot axis.

7. The press key structure of claim 1, wherein there are pivot axes to be formed respectively at the two edges of the first and the second movable panels that are away from each other; and there are pivot seats to be formed at the bottom surface of the keycap at positions respectively corresponding to the pivot axes for allowing the pivot axes to inset therein and thus pivotally coupling the first and the second movable panels to the keycap.

8. The press key structure of claim 7, wherein the pivot axes arranged respectively at the two edges of the first and the second movable panels that are away from each other are extending parallel to the extending of the pivot axis formed by the insetting of at least one flange is into the corresponding at least one groove.

9. The press key structure of claim 7, wherein each of the pivot axes arranged respectively at the two edges of the first and the second movable panels that are away from each other is composed of two shafts, symmetrically attached to two opposite edges of its corresponding panel in an outward extending manner at positions near the edge of the corresponding panel that is far away from the other panel.

10. The press key structure of claim 1, wherein there are support axes being configured respectively at the first and the second movable panels at positions nearing the center thereof; and the substrate is configured with support seats at positions corresponding to the support axes for allowing the support axes to inset therein and thus pivotally coupling the first and the second movable panels to the substrate.

11. The press key structure of claim 10, wherein the support axes arranged at positions nearing the center of the first and the second movable panels are extending parallel to the extending of the pivot axis formed by the insetting of at least one flange is into the corresponding at least one groove.

12. The press key structure of claim 10, wherein, each support axes being configured respectively at the first and the second movable panels at positions nearing the center thereof are composed of two shafts, symmetrically attached to two opposite edges of its corresponding panel in an outward extending manner.

13. The press key structure of claim 10, wherein the support seats of the substrate are so constructed for elevating the first and the second movable panels to a specific height.

14. The press key structure of claim 1, further comprising:

an elastic member, disposed on the substrate at position corresponding to the bottom surface of the keycap in a manner that the elastic member is deformed when the keycap is subjecting to the pressing force enabling the bottom surface to press upon the elastic member, and recovers from the aforesaid deformation when the keycap is released.

15. The press key structure of claim 14, wherein there are a conducting plate arranged at the bottom of the elastic member and a circuit board arranged beneath the substrate while enabling the conducting plate to electrically conduct with the circuit board as soon as the elastic member is pressed by the keycap.

* * * * *